US005386605A

United States Patent [19]

Murphy

[11] Patent Number: 5,386,605

[45] Date of Patent: Feb. 7, 1995

[54] DEVICE FOR ATHLETIC SHOE CLEAT CARE

[76] Inventor: Terry D. Murphy, 3447 SW. Brentwood Dr., Portland, Oreg. 97201

[21] Appl. No.: 113,179

[22] Filed: Aug. 30, 1993

[51] Int. Cl.[6] ..... B25B 13/00

[52] U.S. Cl. ..... 7/138; 7/158; 15/105

[58] Field of Search ..... 7/118, 138, 158; 15/105; 81/124.4, 176.15, 461

[56] References Cited

U.S. PATENT DOCUMENTS

| | | | |
|---|---|---|---|
| D. 241,114 | 8/1976 | Hess . | |
| D. 243,506 | 3/1977 | Hess . | |
| 2,509,980 | 5/1950 | McCallum . | |
| 2,881,648 | 4/1959 | Hottle . | |
| 3,105,257 | 10/1963 | Blagden . | |
| 3,276,299 | 10/1966 | Halburian . | |
| 3,360,807 | 1/1968 | Mauck . | |
| 5,048,138 | 9/1991 | Everroad . | |
| 5,220,701 | 6/1993 | Creato et al. | 7/118 X |
| 5,228,160 | 7/1993 | Porper | 7/158 |

*Primary Examiner*—James G. Smith
*Attorney, Agent, or Firm*—Kolisch, Hartwell, Dickinson, McCormack & Heuser

[57] ABSTRACT

A device for athletic shoe cleat care having two generally perpendicular elongate members, each member having two ends which each include a cleat care tool. In the preferred embodiment, a first end includes a burr remover, a second end includes a cleat cleaning tool, a third end includes a hexagon-shaped wrench, and a fourth end includes a prong wrench.

23 Claims, 1 Drawing Sheet

FIG. 1
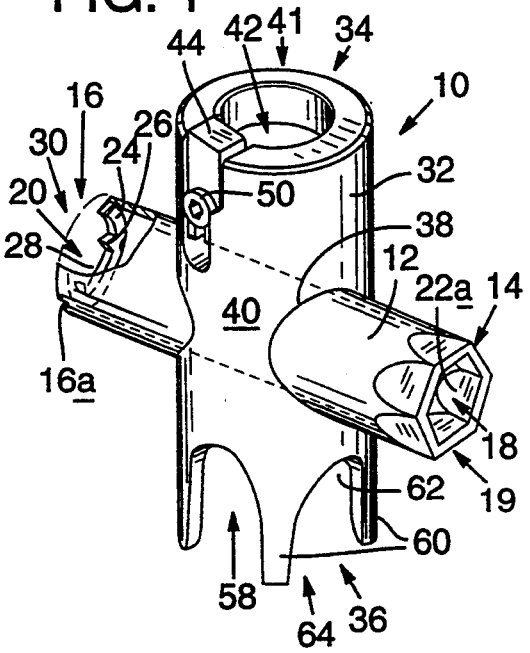
FIG. 3
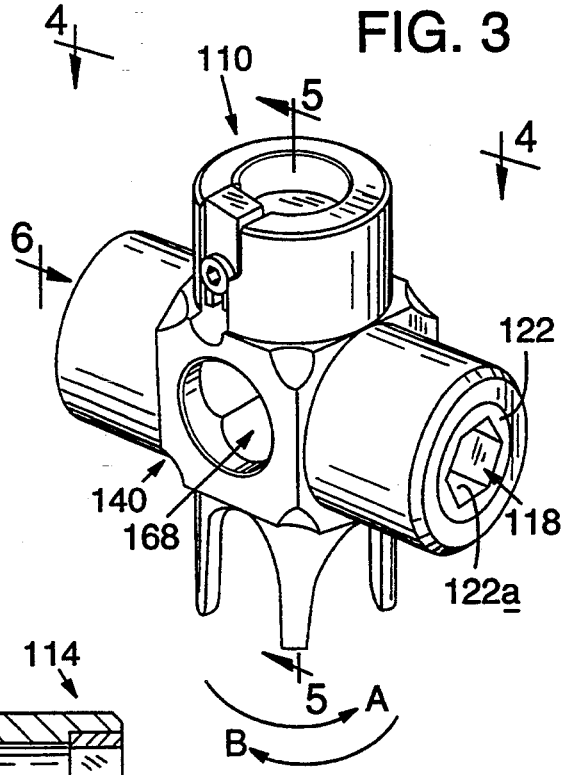
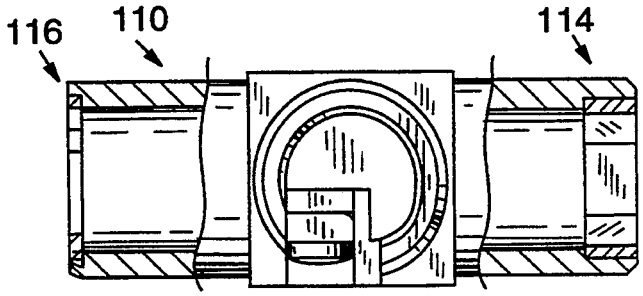
FIG. 4
FIG. 5
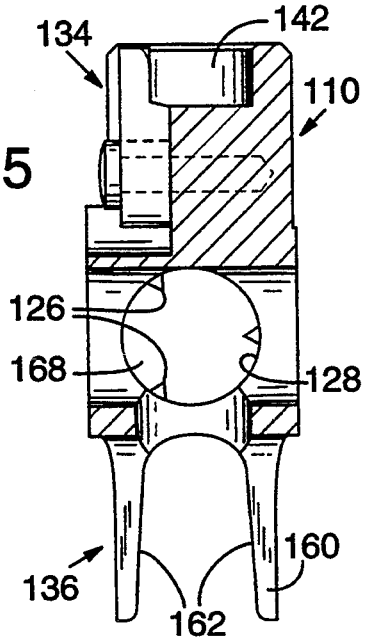
FIG. 6
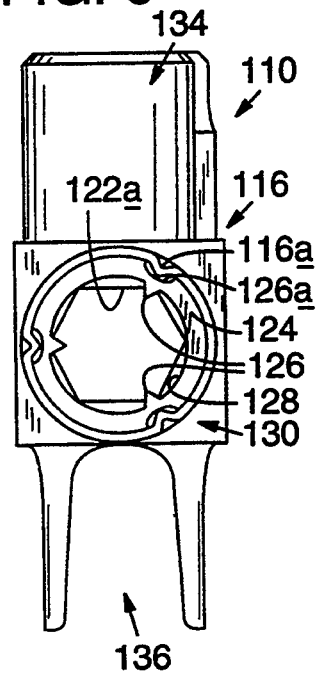
FIG. 2
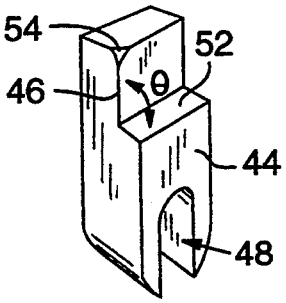

DEVICE FOR ATHLETIC SHOE CLEAT CARE

BACKGROUND OF THE INVENTION

This invention relates generally to athletic shoe spike or cleat tools, and more specifically to a tool design to be used with spikes of rubber or plastic, which wear down upon use, such as soccer shoes and juvenile softball and baseball shoes.

Soccer shoes, softball shoes and the like typically include cleats extending from the sole of the shoe to improve the traction of the shoe. The cleats are generally in the shape of truncated cones having inclined sides and a flat end portion for contacting the ground. Typically, such cleats are manufactured of resilient plastic or rubber. Often these cleats are removably attached to the shoe by a screw type mechanism. Shoes are manufactured with these removable cleats so that the cleats can be replaced when worn, or changed when a wearer desires different cleats for different weather or different playing surface conditions. These removable cleats typically include a base portion having prong-shaped indentations or a hexagon-type outer shape such that a correspondingly shaped wrench can effect tightening or loosening of the cleat base relative to the shoe.

When athletes wear cleats on soccer fields, baseball fields, or the like, sharp objects such as glass, sticks or rocks can mar or deform the outer surface of the cleat. Specifically, the cleat's side surface can become worn or deformed such that plastic burrs or projections extend outwardly from the cleat. To maximize traction of the cleats, these burrs should be removed. Additionally, when such shoes are used in muddy or thick grass conditions, debris becomes adhered to the outer surface of the cleat. The debris, such as mud and grass, becomes more tightly packed about the cleat with each step the user takes. To increase traction of the cleats, the debris should be removed from around the cleat. Often, the debris is so tightly packed that scraping only one side of the rounded cleat is insufficient to remove the debris and repeated scrapings are necessary.

Also, it is typical that before a game begins, referees inspect the cleats of each player to make sure the players' cleats are free of burrs. Apparently the feeling is that burrs and the like can result in players injuring one another in the event cleats of one player come into contact with another player.

There are several prior art devices which have attempted to address these problems. U.S. Pat. No. 2,509,980 to McCallum describes a shoe cleat remover. However, the McCallum device serves only this one function and is not used to clean debris away from the cleat. Similarly, U.S. Pat. No. 2,881,648 to Hottle describes a cleat removal device that is not used for cleaning debris from the cleat. Everroad, U.S. Pat. No. 5,048,138, describes a shoe prong wrench and cleaning tool, but the tool does not include multiple removal or multiple cleaning devices. In addition, the tool must be manipulated into the "working position" from the "folded rest position" before use. Blagden, U.S. Pat. No. 3,105,257, describes an article for cleaning golf shoes and golf clubs but this device does not encircle a spike to remove packed mud or grass from around the golf shoe spoke, and so repeated scrapings are required.

Thus, there is a need for a compact, inexpensive cleat care device which can be used to remove burrs from the cleat, remove debris from around the cleat, and which can be used for tightening and loosening removable cleats. Additionally, there is a need for a cleat care device which encircles a cleat to allow the user to apply force to remove debris in one motion, without the device slipping off the cleat and without requiring repeated scrapings. Therefore, it is an object of the present invention to overcome the drawbacks and limitations of the proposals of the prior art. More specifically, the present invention has as its objects the following:

(1) a versatile multi-tool device that performs several functions such as cleat removal/fastening, cleat cleaning and burr removal;
(2) a device manufactured to facilitate leverage for turning the device to effect cleat removal or cleaning;
(3) a device that is inexpensive to manufacture;
(4) a device that easily can be used by children;
(5) a compact device that can be carried in a pocket;
(6) a durable device having no moving parts; and
(7) a device that cleans debris in one motion without repeated scrapings.

SUMMARY OF THE INVENTION

Briefly, the invention comprises a first elongate member having a first end region and a second end region, the first end region defining a hollow region such that a cleat may be fittingly received in the hollow region, a blade including an edge, the blade positioned on the first end region such that the edge extends into the hollow region thereby removing burrs from the cleat as relative rotation is effected between the cleat and the device, and a second elongate member mounted perpendicularly to the first elongate member and terminating in first and second end portions, each such end portion including a cleat care tool. In the preferred embodiment, the elongate members are generally tubular in configuration and at least one of the elongate members is formed of plastic. Typically, the first end region includes a blade and a first hollow region which comprise a cleat burr remover, the second end region includes prongs and a second hollow region which define a cleat cleaning device, the first end portion includes a hexagon-shaped wrench and the second end portion includes a prong wrench. The device may also include a hole in the central portion of the cross-shaped device to facilitate use of a universal driver for increased leverage when using the device.

Other objects, features and advantages of the invention will become apparent as this description continues.

BRIEF DESCRIPTION OF THE DRAWINGS

FIG. 1 shows a first, preferred embodiment of the athletic shoe cleat care device including a partially cut-away and sectional view of one portion of the device.

FIG. 2 shows an isometric view of the blade component of the cleat care device of FIG. 1 or FIG. 3.

FIG. 3 shows an isometric view of a second embodiment of the device.

FIG. 4 shows a partially sectioned top plan view taken along line 4—4 of FIG. 3.

FIG. 5 shows a partially sectioned end elevational view taken along line 5—5 of FIG. 3.

FIG. 6 shows an end elevational view of the device of FIG. 3 viewed from direction 6.

DETAILED DESCRIPTION OF THE PREFERRED EMBODIMENTS

FIG. 1 shows the preferred embodiment of the athletic shoe cleat care device 10. The device includes a first elongate member 12 having a first end region 14 and a second end region 16. First end region 14 includes a first hollow region 18 and second end region 16 includes a second hollow region 20. Typically, first hollow region 18 is formed in the shape of a hexagon wrench 19 such that first hollow region 18 can be fittingly engaged over a hexagon-shaped cleat or cleat base with contact surfaces 22*a* of first end region 14 positioned adjacent the side of the cleat. In the preferred embodiment, member 12 is a hollow, tubular-shaped member manufactured of metal, such as aluminum. Typically, member 12 is 1½ inches long, has an outer diameter of ½ inch, and a thickness of 1/16 inch. Manufacturing member 12 of metal allows end 14 easily to be shaped into hexagon shape 19.

However, member 12 can alternatively be manufactured of plastic. In this alternative embodiment, end region 14 is manufactured of plastic and a metal insert 122, shown in FIG. 3, may be secured in hollow region 118. (In this alternative embodiment, elements are numbered in a one-hundred series to correspond to like elements in the preferred embodiment. Additionally, views of the preferred embodiment illustrated in FIG. 1 would, if shown, correspond to FIGS. 4–6, showing views of the alternative embodiment.)

Now turning to the other end of member 12, second end region 16 typically includes an insert 24 having three prongs 26. These prongs are equally spaced around the inner circumference 28 of insert 24, thereby forming a prong wrench 30 for tightening or loosening a cleat on an athletic shoe. The prongs typically extend 1/16 of an inch into hollow region 20 and are 1/16 inch thick. Insert 24 is secured to tubular member 12 by protrusions 16*a* on second end region 16.

In another embodiment, prongs 126 may be integrally molded with second end region 116. In yet another embodiment, where second end region 116 is manufactured of plastic or cast aluminum, an insert 124 of metal is preferably used. Insert. 124 is prevented from moving relative to end region 16, due to protrusions 116*a* and corresponding indentations 126*a* of insert 126.

Cleat care device 10 further includes a second elongate member 32 having a first end portion 34 and a second end portion 36. First end portion 34 and second end portion 36 can also be referred to as third end region 34 and fourth end region 36, respectively, of device 10. Typically, second elongate member 32 is mounted perpendicularly to first elongate member 12. In the preferred embodiment, second elongate member 32 is manufactured of plastic and has an orifice 38 which passes through a central region 40 of member 32. First member 12 is securely positioned within orifice 38 such that the members define a generally cross, or "X" type shape. In the preferred embodiment, both elongate members are tubular in configuration, for ease of manufacturing and strength of design. Second elongate member 32 is typically manufactured of high density polyethylene, is 2 inches long and is ¾ inch in diameter.

Further defining second member 32, first end portion 34 includes a hollow region 42. Typically, a blade 44 is positioned on first end portion 34. Hollow region 42 and blade 44 together define cleat burr remover 41. Blade 44 includes an edge, or cutting surface 46, as shown in FIG. 2. The blade further includes a recess 48 so that the blade may be secured to first end portion 34 by a screw, or pin 50 through recess 48. The blade is secured on first end portion 34 such that edge 46 extends into hollow region 42. The blade further includes a fiat surface 52 such that edge 46 defines an angle $\theta$, with fiat surface 52. Typically, $\theta$ is slightly more than 90°, e.g. 95°, such that when a cleat having an inclined side is placed within hollow region 42, the inclined side of the cleat is generally parallel to and in a tight fitting relationship with edge 46. Additionally, blade 44 includes safety surface 54 so that edge 46 will not mar the base portion of a cleat or the sole of a shoe. Safety surface 54 also reduces the possibility of users cutting their hands or fingers on edge 46.

Now turning to the other end of elongate member 32, second end portion 36 includes a hollow region 58, typically defined by legs 60. Legs 60 and hollow region 58, together define cleaning device 64. In the preferred embodiment, second end region 36 includes four evenly spaced legs 60 (only three of the four legs can be seen in FIG. 1), each leg having a contact surface 62. Contact surfaces 62 define hollow region 58 such that when a cleat is fittingly received in hollow region 58, contact surfaces 62 are generally parallel to the side of the cleat, facilitating removal of debris when the debris is moved relative to the cleat.

In another embodiment, central region 140, shown in FIG. 3, of device 110 includes a hole 168. In this embodiment, hole 168 is typically round such that leverage of the device during rotation can be increased by using a universal driver, such as a screwdriver, positioned through hole 168. Due to the round shape of the hole, the universal driver can be used to increase leverage when using any of the four tools, one located on each end of the device. Incorporation of hole 168 in device 110 has the added advantage of reducing the amount of raw materials necessary for manufacturing, thereby reducing the cost of manufacturing device 110. Additionally, hole 168 allows device 110 to be secured on a string, or the like, such that the device can be securely fastened to a sport bag.

In the preferred embodiment, first member 12, containing hexagon wrench 19 and prong wrench 30, is manufactured of metal, and second member 32, containing burr remover 41 and debris remover 64, is manufactured of plastic. This combined metal-plastic device is believed to be the strongest and most cost-effective embodiment. Specifically, in such an embodiment the hexagon wrench and the prong wrench are manufactured of metal such that the wrenches can withstand a relatively large amount of force (a large amount of force is necessary when removing or tightening a cleat on a shoe). Second member 32 is manufactured of plastic, lowering the cost and weight of the device (a lesser amount of force is necessary when removing burrs or debris from the cleat).

To use hexagon wrench 19, hollow region 18 of device 10 is positioned around a cleat (not shown) such that the cleat is fittingly received within the hollow region. Typically, a cleat used with the hexagon wrench has a generally hexagon-shaped outer surface or a hexagon-shaped base portion such that hexagon wrench 19 can effect tightening or loosening of the cleat from the shoe. The contact surfaces 22*a* of the wrench engage corresponding surfaces of the cleat base portion, thereby urging the cleat to move simultaneously with the hexagon wrench, and not with the shoe. Once the hexagon wrench is secured about the hexagon portion of a cleat, relative rotation is effected between the shoe and the device such that the cleat is loosened, or in an opposite direction such that the cleat is tightened on the shoe. Typically, the relative rotation loosens, or tightens as the case may be, a screw manufactured integral with the cleat, from a screw receiving hole in the sole of the shoe (not shown). In this manner, a user can replace worn cleats or tighten existing cleats.

To use prong wrench 30, hollow region 20 is placed around a cleat such that the cleat is fittingly received in the hollow region. In placing the prong wrench over a cleat, or conversely, in placing a cleat into the prong wrench, the user aligns the prongs with indentations on the side surface of the cleat base portion such that the prongs engage the indentations. The device, or conversely the shoe, is then rotated such that relative rotation is effected between the shoe and the device. The prongs of the wrench engage the indentations of the cleat thereby urging the cleat to move in unison with the wrench and not in unison with the shoe. Relative rotation in one direction will tend to tighten the cleat whereas relative rotation in the other direction will tend to loosen the cleat. In this manner, a user can remove and replace a worn cleat or tighten an existing cleat.

To use cleat burr remover 41, blade 44 is secured to first end 34 by screw 50 such that edge 46 extends into hollow region 42. Typically, blade 44 is securely fastened to first end 34 before sale. The adjustment of blade 44 on end 34 is facilitated by positioning pin 50 at any position within cut-out region 48. Adjustment of the blade allows the edge to be aligned with cleats of various heights and allows the user to remove the blade for sharpening. The device is then positioned such that a cleat is fittingly received within hollow region 42. Relative rotation is then effected between the cleat and the device by turning the shoe and the attached cleat and holding the device steady, or by holding the shoe and the attached cleat steady and turning the device. As relative rotation is effected between the cleat and the device, the device rotates in direction A, shown in FIG. 3, with respect to the shoe and the cleat, and the shoe and the cleat rotate in direction B with respect to the device. Similarly, the directions of rotation can be reversed. In this manner, burrs and projections from the cleat are removed by burr removing device 41. Specifically, end 34 is manufactured such that hollow region 42 fits snugly around a cleat such that the side of the cleat is positioned adjacent or contacting the side wall of hollow region 42 and contacting the edge of blade 44. Due to this tight-fitting relationship, and due to the sharpness of edge 46, projections on the cleat will be removed by edge 46 as the projections contact the edge during relative rotation. In another embodiment (not shown), edge 146 can be placed on an opposite side of blade 144 such that the direction of rotation to effect burr removal is reversed.

To use cleat cleaning device 64, a cleat is fittingly received in hollow region 58 and relative rotation is effected between the cleat and the device to clean debris, such as mud and grass, from around the cleat. Specifically, legs 60 are manufactured such that when the legs are positioned about the cleat, contact surfaces 62 are in a tight fitting, or closely adjacent relationship with the cleat side surfaces. Thus, as relative rotation is effected, the contact surfaces 62 remove debris from about the cleat, the debris falling off the shoe sole and the cleat through the spaces located between the spaced legs. Thus, even in cases where debris is tightly compacted around the cleat, legs 60 slide into the debris such that ends 66 of the legs are positioned adjacent the sole of the shoe because applicant's inventive device must only displace a relatively small amount of debris during positioning of the legs about the cleat. The single rotational movement of applicant's cleaning device 64 effectively cleans debris from all sides of a cleat without repeated scrapings, as required when using the flat knife-type devices of the prior art. In addition, the cleat-surrounding configuration of applicant's device allows the user to apply large amounts of force, compared with prior art flat devices, without applicant's device slipping off the circular cleat.

While preferred embodiments of the invention have been disclosed and described herein, it is appreciated that variations and modifications may be made without departing from the spirit and scope of the invention. Those variations and modifications are intended to be covered by the following claims.

It is claimed and desired to secure by Letters Patent:

1. A wrench device for shoe cleat care, the device comprising:

a member including outwardly extending end regions, a first end region having a cleat cleaner and a second end region having a cleat burr remover, the cleat burr remover comprising a first hollow region for receiving a cleat and a blade including an edge, the blade positioned on the member such that the edge extends into the first hollow region to remove burrs from the cleat as relative rotation is effected between the cleat and the device.

2. The device of claim 1 wherein the cleat cleaner comprises legs which define a second hollow region for receiving a cleat such that the legs remove debris from the cleat as relative rotation is effected between the cleat and the device.

3. The device of claim 1 wherein the device includes a fourth end region, the fourth end region having a prong wrench.

4. The device of claim 1 wherein two of the four end regions are formed of plastic.

5. The device of claim 1 wherein two of the four end regions are formed of metal.

6. The device of claim 1 wherein the device is formed of plastic.

7. The device of claim 1 wherein the device is formed of metal.

8. The device of claim 1, further comprising a third end region having a hexagon-shaped wrench.

9. A device for shoe cleat care, the device comprising:

a first elongate member having a first end region, the first end region defining a first hollow region for receiving a cleat;

a blade including an edge, the blade positioned on the first end region such that the edge extends into the first hollow region to remove burrs from the cleat as relative rotation is effected between the cleat and the device; and a second elongate member mounted perpendicularly to the first elongate member and terminating in first and second end portions, each such portion including a cleat care tool, wherein one of the cleat care tools is a hexagon wrench.

10. A device for shoe cleat care, the device comprising:

a first elongate member having a first end region, the first end region defining a first hollow region for receiving a cleat;

a blade including an edge, the blade positioned on the first end region such that the edge extends into the first hollow region to remove burrs from the cleat as relative rotation is effected between the cleat and the device; and a second elongate member mounted perpendicularly to the first elongate member and terminating in first and second end portions, each such portion including a cleat care tool, wherein one of the cleat care tools is a prong wrench.

11. A device for shoe cleat care, the device comprising:

a first elongate member having a first end region, the first end region defining a first hollow region for receiving a cleat;

a blade including an edge, the blade positioned on the first end region such that the edge extends into the first hollow region to remove burrs from the cleat as relative rotation is effected between the cleat and the device; and a second elongate member mounted perpendicularly to the first elongate member and terminating in first and second end portions, each such portion including a cleat care tool; and an aperture defined adjacent the intersection of the first elongate member and the second elongate member, the aperture adapted to receive leverage when rotation is effected between a cleat and the device.

12. The device of claims 9, 10 or 11 wherein the blade and the first end region define a gap for receiving debris generated by removal of burrs from a cleat.

13. The device of claims 9, 10 or 11 wherein the first hollow region includes a bottom face designed to receive and contact the end portion of a cleat.

14. The device of claims 9 or 10, further comprising an aperture defined adjacent the intersection of the first elongate member and the second elongate member, the aperture adapted to receive leverage when rotation is effected between a cleat and the device.

15. The device of claims 10 or 11 wherein one of the cleat care tools is a hexagon wrench.

16. The device of claims 9 or 11 wherein one of the cleat care tools is a prong wrench.

17. The device of claims 9, 10 or 11 wherein the cleat has substantially horizontal and substantially vertical surfaces and wherein the blade includes first and second cutting edges, the first cutting edge acting on the substantially horizontal surface of the cleat and the second cutting edge acting on the substantially vertical surface of the cleat.

18. The device of claims 9, 10, or 11 wherein the elongate members are generally tubular in configuration.

19. The device of claims 9, 10, or 11 wherein at least one of the elongate members is formed of plastic.

20. The device of claims 9, 10, or 11 wherein at least one of the elongate members is formed of metal.

21. The device of claims 9, 10, or 11 wherein the elongate members are formed as an integral unit.

22. The device of claims 9, 10 or 11 wherein the first elongate member includes a second end region, the second end region including a cleat cleaner.

23. The device of claim 22 wherein the cleat cleaner comprises legs which define a second hollow region for receiving a cleat, the legs thereby removing debris from the cleat as relative rotation is effected between the cleat and the device.

* * * * *